United States Patent [19]

Levine

[11] Patent Number: 4,512,581

[45] Date of Patent: Apr. 23, 1985

[54] HIDDEN MESSAGE PUZZLE PACKET

[75] Inventor: Paula B. Levine, Skokie, Ill.

[73] Assignee: Paula Blaine International, Ltd., Skokie, Ill.

[21] Appl. No.: 459,381

[22] Filed: Jan. 20, 1983

[51] Int. Cl.[3] ..... A63F 9/06

[52] U.S. Cl. ..... 273/153 R; 434/121; 434/177; 434/354; 434/363

[58] Field of Search ..... 273/153 R; 46/35; 434/177, 363, 364, 121, 354

[56] References Cited

U.S. PATENT DOCUMENTS

| | | | |
|---|---|---|---|
| 1,033,576 | 7/1912 | Garman | 46/35 |
| 1,217,632 | 2/1917 | Pritchard | 273/157 R |
| 1,625,218 | 4/1927 | Lundy | 273/157 R UX |
| 2,010,830 | 8/1935 | Staudte | 273/157 R X |
| 2,544,961 | 3/1951 | Kemp | 273/153 R |
| 4,138,115 | 2/1979 | Gans | 273/153 R |

*Primary Examiner*—Anton O. Oechsle
*Attorney, Agent, or Firm*—Kegan & Kegan

[57] ABSTRACT

A puzzle packet which includes a greeting card containing a "hidden message. " The message appears only on a see-through sheet which is detachably fastened to overlie a panel of the card in registry with a panel-imprinted crossword puzzle-type lattice. The lattice has filled and open squares, and spaced numbers each keyed to either an "across" or a "down" heading. A purchaser of the greeting card, having noted the message, detaches the message-imprinted sheet and encloses it in a small envelope attached to the card. Should the one to whom the purchaser then sends the packet be unable to solve the puzzle to learn the message, he may resort to the preprinted answer in the small envelope.

1 Claim, 4 Drawing Figures

HIDDEN MESSAGE PUZZLE PACKET

BACKGROUND AND FIELD OF THE INVENTION

Many types of greeting cards, worded and fashioned for many different events or occasions are known and are widely distributed and exchanged. Such cards include birthday greetings, anniversary congratulations, "get well" cards, holiday greetings, and cards for graduations and confirmations, and many others. The prior art is also replete with almost endless types of games and puzzles. However, heretofore, the desirability of inter-relating greeting cards and puzzles has not been generally recognized and greeting cards and puzzles have seldom been combined to effect a single special purpose. Specifically, greeting cards which, in cooperation with a puzzle, relay or express a "message" to the card recipient are relatively rare, if such exist at all.

A principal aim of the present invention is, through a novel approach, to provide, for a single purpose, a unitary assembly consisting of a puzzle integrated with a greeting card.

SUMMARY OF THE INVENTION

The present invention relates to a puzzle packet. More particularly, the invention is related to a puzzle-presenting packet in greeting card format. The packet contains a "hidden message" physically accompanying but sequestered on a greeting card. The same message is also retrievable upon solving a crossword-type puzzle which is imprinted on and "clued" on the greeting card itself. As an additional element of the packet of the invention, the correct completed solution to the puzzle is reproduced on a sheet removably contained in a separate envelope attached to and constituting a component of the packet.

It is an important feature of the invention that the "message" hidden in the puzzle may be any selectable message tailored to the particular occasion for or purpose of each specific greeting card.

A practical and advantageous feature of the combination puzzle and greeting card of the invention is that the postage required for mailing is no more than for a greeting card alone.

Yet another feature of the "hidden message" greeting card of the invention is that the cover panel may be imprinted with attractive artwork including an admonition or advice calling immediate attention to the unique nature of the packet being offered for sale.

A related feature of the invention is that the recipient of the greeting card and puzzle packet, immediately perceiving the announcement on the cover panel of the packet and knowing that a "hidden message" has been delivered, senses the challenge presented by and the need to solve a puzzle.

Still another feature of the packet of the invention is that the solution to the puzzle is "hidden" but at hand should the recipient of the card experience difficulty in correctly filling in the crossword pattern.

Other and further features of the invention will be evident upon a reading of the following detailed description considered in conjunction with the drawing.

DETAILED DESCRIPTION OF PREFERRED EMBODIMENT

The aims and objects of the invention are accomplished by providing a combination puzzle-greeting card packet in the physical form of a folded card panels of which are imprinted to present a crossword-type puzzle as well as "clues" for its solution. Additionally, the card carries a removable overlay sheet imprinted with the puzzle solution, and an attached storage envelope in which the sender of the packet puts the solution, out of view against premature disclosure.

Figure 1:
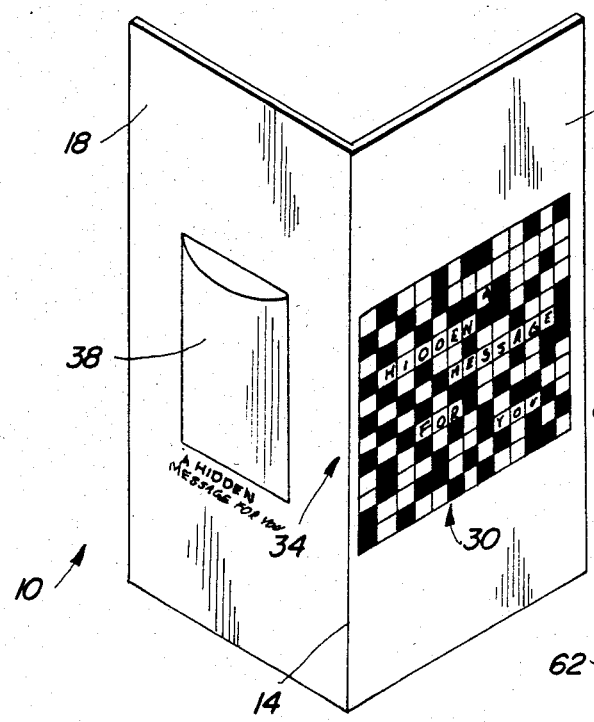
FIG. 1 is a perspective view of a packet according to the invention and showing the patterned cover panel, and the message-containing envelope fastened in place on an outer rear panel of the packet.
Figure 2:
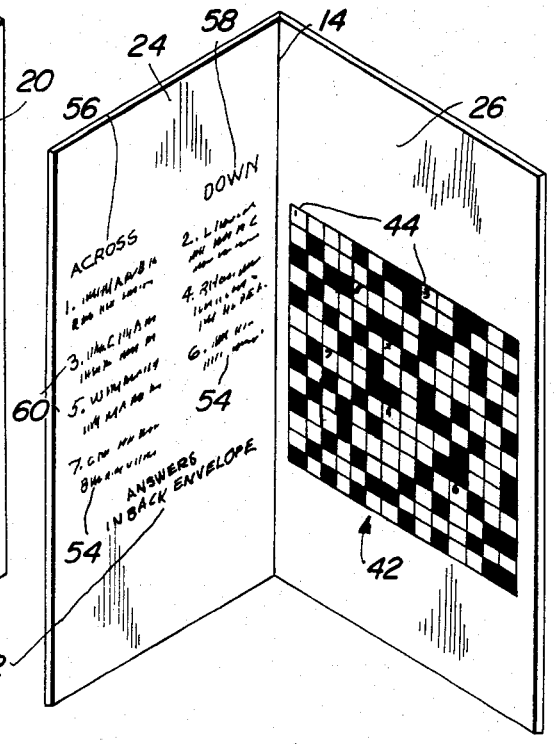
FIG. 2 is a perspective view of the inner facing panels of the greeting card of the packet, as received from the sender, and showing the crossword puzzle, but with its transparent overlay answer sheet removed, and also showing the "clues" for doing the puzzle.

Referring now to the drawings, there is shown one preferred embodiment of the puzzle-greeting card packet of the invention provided for illustrative purposes and not to be construed in any limiting sense. The packet 10 illustrated includes a greeting card formed as a sheet of paper or from cardbaord 12, or the like, folded over upon itself along a hinge-like center fold line 14. The folded card 12 forms a four-panel structure having front and rear outer or outside panels 18 and 20 (FIG. 1) and a pair of inner or inside panels 25 and 26 (FIG. 2). The top outer panel 20 or cover panel of the greeting card may be decorated in any desired manner and style using any preferred artwork either alone or in combination with printed matter—or using printed matter alone.

In the exemplary packet depicted, the top outer panel 20 or cover of the greeting card 12 is imprinted in the style of a crossword puzzle lattice 30 calculated to attract attention and to elicit interest. The import of the declaration is enhanced and clarified by a legend 34 imprinted on the crossword lattice itself. In the particular specific structure depicted, the legend 34 reads "a hidden message for you." Any other preferred notation may be used, if desired.

The back or rear panel 18 of the folded card 12 carries a small envelope 38 which is glued or otherwise fastened in place. The function of the envelope 38 is to sequester or to keep the solution to the puzzle from view, as will be more fully explained herebelow. Advice 40 imprinted below the envelope 38 reads "a hidden message for you." The inside or inner panels or "pages" 24 and 26 of the packet 10 are illustrated in FIG. 2. As shown, the right hand panel 26 is imprinted with a crossword puzzle lattice 42 including a plurality of spaced reference numbers 44. The left hand panel 50 facing the puzzle lattice 42 is imprinted with legends 54 arranged in "across" 56 and "down" 58 columns and numbered 60 in correspondence with the numbers 44 which appear on the crossword lattice 42 itself. The legends 54 constitute the "clues" to be used in filling in or "solving" the crossword puzzle 42. Below the tabulated legends appears the advice 62 "answers in back envelope."

Figure 3:
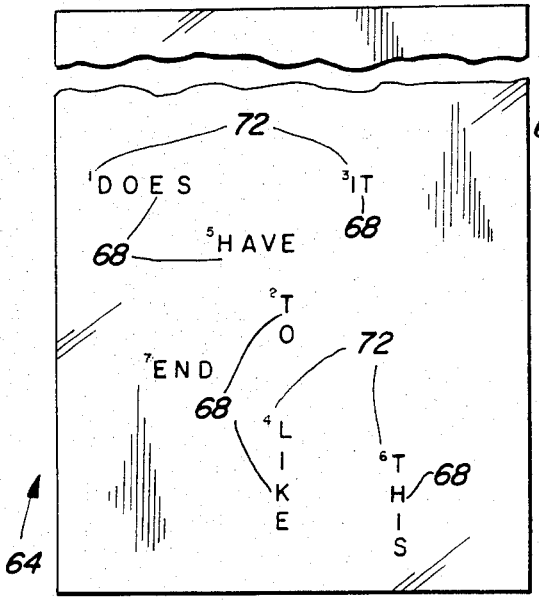
FIG. 3 is a plan view, somewhat enlarged, of the removed transparent overlay sheet of the packet of the invention and show the message-portraying solution to the puzzle.

At the time of purchase of the puzzle-packet 10 of the invention, the puzzle lattice 42 of the inner panel 26 is covered by a transparent overlay 64 which may be tissue paper or similar sheet stock. The overlay sheet 64, removed from or separated from the crossword puzzle lattice of the inner panel 26 is illustrated in FIG. 3.

As indicated, the cover sheet 64 is imprinted with a message consisting of a group of words 68, each word being located physically at a number 72 which correlates with and is physically placed or oriented for registry with the earlier-identified corresponding numbers 44 imprinted on the lattice 42 of the support sheet or support panel 26. The words 68 on the tissue sheet 64 constitute or portray the "message" of the greeting card-puzzle packet. In the specific example shown, the message is "Does It Have To End Like This."

Figure 4:
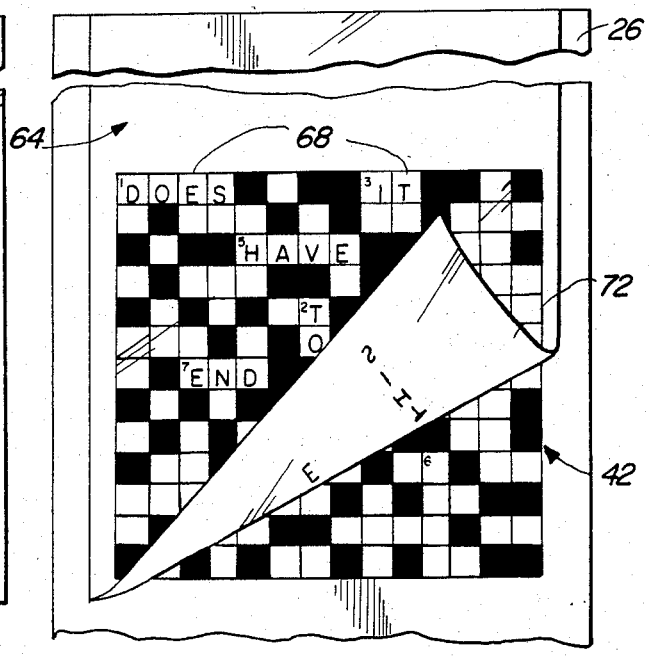
FIG. 4 is a plan view, somewhat enlarged, of the crossword puzzle of the packet, with the message-containing transparent cover sheet attached, and indicating schematically how the cover sheet (and its message) are removed for deposit in the packet envelope.

The message-support panel 26, with the message imprinted cover sheet 64 fastened or glued in place to overlie the lattice 42, is shown in FIG. 4. The cover sheet 64 and the numbers 72 are in registry with the crossword lattice 42 and its numbers 44 so that the pattern 42 shows through the transparent cover sheet 64, and the "message" appears to have been "filled in" on the crossword puzzle itself. The above describes how the inside right panel 26 of the packet 10 appears when seen by the purchaser of the greeting card-puzzle. In FIG. 4, a portion of the lower right hand quadrant 72 of the cover sheet 64 has been folded back to emphasize that the underlying pattern 42 does not carry the words of the "message," but only the keyed "numbers" 44.

The foregoing detailed description will make clear the manner in which the "hidden message" packet 10 of the invention is used. As purchased by the sender, the transparent message-carrying tissue sheet 64 is fastened in place to overlie the support panel 26, in registry. In this mode, the message is clearly legible and appears as if it were "filled in" on the crossword pattern 42 (FIG. 4). The sender of the packet 10, having noted the message, separates the message-carrying cover sheet 64 from the support panel 26, folds the tissue 64 and seals it in the envelope 38 on the back 18 of the packet 10. The inside of the "greeting card" then appears as in FIG. 2, with no message visible.

The recipient of the packet 10 is advised by the legend 34 on the cover panel 20 that the packet involves a "hidden message." Upon opening the folded card, the recipient understands that he is to solve a crossword puzzle. He will proceed to do this, and learn the "message." Should he experience difficulty or should he be unable to "work" the crossword puzzle, resort may be had to the solution contained in the attached sealed envelope 38.

While a preferred embodiment of the invention has been illustrated and described, other variations may be made utilizing the inventive concepts herein disclosed. It is intended that all such variations be considered as within the scope of the invention as defined in the following claims.

What is claimed is:

1. A puzzle-presenting message greeting card comprising:

a support panel for carrying imprinted reference indicia thereon;

a lattice-like pattern imprinted on said support panel on one surface face thereof, said pattern having a plurality of reference numbers imprinted thereon at spaced, selectable loci of said pattern;

a cover panel having substantially the same quadrilateral shape and approximately the same dimensions as said support panel, said support panel and said cover panel each having a side edge thereof fixedly and pivotally connected to the side edge of the other of said support panel and said cover panel to form an openable greeting card, such that, when said card is opened, said pattern is visible immediately;

said cover panel having printed material on the front surface face thereof, which front surface face faces away from said support panel when said greeting is closed, such that said cover panel overlies said one surface face of said support panel, said printed material communicating an idea about the contents of said pattern;

said cover panel further comprising an array of legand means formed on the rear surface face thereof, which rear surface face faces toward said one surface face of said support panel when said greeting card is in its normally-closed position in overlying-fashion, said legand means giving instructions to fill out the lattice-like pattern of said one surface face of said support panel;

a translucent recordation sheet made of a flexible material to allow for the folding thereof, said translucent recordation sheet also having substantially the same quadrilateral shape as said support panel for fitting over said pattern; said translucent recordation sheet being positioned over said one surface face of said support panel for overlying said pattern; said translucent recordation sheet having imprinted thereon printed matter arranged such that it overlies said pattern to fill it in to give the information desired to be conveyed by said greeting card, said printed material of said recordation sheet being arranged in a manner similar to the reference numbers of said pattern.

said support panel further having another surface face constituting the rear thereof facing away from said cover panel when said cover panel overlies said support panel in a parallel-like arrangement in its normally-closed position; said support panel further comprising an envelope fixedly attached to said another rear surface face thereof, said envelope having a sealable flap portion for sealing of said envelope, said envelope having a size substantially smaller than said another rear surface and having substantially the same quadrilateral shape as said another rear surface face and being arranged on said another rear surface face such that the sides of the quadrilateral of said envelope lie adjacent corresponding sides of said another rear surface face quadrilateral; said envelope further having a size great enough to hold therein said recordation sheet when said recordation sheet has been removed from said one surface face of said support panel and has been folded; and means for adhesively attaching said recordation sheet to said one surface face of said support panel, said means for adhesively attaching securing said recordation sheet to said support panel for easy separation thereof.

* * * * *